US006694934B1

(12) United States Patent
Preston et al.

(10) Patent No.: US 6,694,934 B1
(45) Date of Patent: Feb. 24, 2004

(54) VARIABLE VALVE ACTUATOR FOR INTERNAL COMBUSTION ENGINE

(75) Inventors: David M. Preston, Clarkston, MI (US); Donald R. Haefner, Troy, MI (US); David H. Scharnweber, Clinton Township, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/302,019

(22) Filed: Nov. 22, 2002

(51) Int. Cl.[7] ..... F01L 1/34

(52) U.S. Cl. ..... 123/90.16; 123/90.27; 123/90.31; 123/90.39; 123/90.6

(58) Field of Search ..... 123/90.15, 90.16, 123/90.17, 90.24, 90.25, 90.26, 90.27, 90.39, 90.41, 90.44, 90.6

(56) References Cited

U.S. PATENT DOCUMENTS

| | | | | |
|---|---|---|---|---|
| 5,501,186 A | * | 3/1996 | Hara et al. | 123/90.16 |
| 6,019,076 A | | 2/2000 | Pierik et al. | 123/90.16 |
| 6,041,746 A | | 3/2000 | Takemura et al. | 123/90.16 |
| 6,123,053 A | | 9/2000 | Hara et al. | 123/90.16 |
| 6,367,436 B2 | * | 4/2002 | Pierik | 123/90.16 |
| 6,378,474 B1 | | 4/2002 | Pierik | 123/90.16 |
| 6,386,161 B2 | | 5/2002 | Pierik | 123/90.16 |
| 6,422,187 B2 | | 7/2002 | Fischer et al. | 123/90.16 |
| 6,497,206 B2 | * | 12/2002 | Nohara et al. | 123/90.16 |

* cited by examiner

*Primary Examiner*—Thomas Denion
*Assistant Examiner*—Ching Chang
(74) *Attorney, Agent, or Firm*—L. J. Kasper

(57) ABSTRACT

A variable valve actuation assembly (41) to be mounted about a camshaft (43) including a concentric portion (47) and an eccentric portion (49) which orbits the axis of rotation (A1) of the camshaft and defines an axis (A2). The assembly (41) includes a secondary cam member (51) surrounding the concentric portion (47) and including a cam surface (59,59L). The assembly (41) also includes an arm assembly (61) which surrounds the eccentric portion (49), and defines a longitudinal axis (A3) perpendicular to, and intersecting the axis (A2). The arm assembly (61) can pivot about a pin (71), and at the opposite axial end is pivotally connected to the secondary cam member (51) by means of a pin (75). Rotation of the camshaft (43) causes the arm assembly (61) to pivot about the pin (71) in one direction, rotating the cam member (51) to lift the valve (17), then pivot in the other direction, rotating the cam member (51) in the opposite direction.

8 Claims, 6 Drawing Sheets

VARIABLE VALVE ACTUATOR FOR INTERNAL COMBUSTION ENGINE

BACKGROUND OF THE DISCLOSURE

The present invention relates to valve control systems for internal combustion engine poppet valves, and more particularly, to such valve control systems which are capable of controlling the amount of the valve lift, the timing of the valve lift, and the duration of the valve event (the valve lift).

As is well known to those skilled in the internal combustion engine art, conventional camshaft and rocker arm type valve gear trains are relatively simple and have been generally effective in commercial use. However, the conventional camshaft-actuated valve gear train has typically represented a compromise in regard to engine performance. At relatively low speeds and loads, the engine poppet valves open more than is needed, while at relatively higher engine speeds, the valves do not open enough to get the flow quantity of air-fuel mixture necessary to achieve optimum engine performance. At relatively low speeds, if the amount of valve opening could be reduced, such that the poppet valve could serve as a flow "throttle", the engine pumping losses could be reduced.

In addition, it is now understood that engine efficiency can be improved by varying the timing of the opening and closing of the poppet valves as a function of engine speed, and also as a function of load on the engine. One known method of varying the timing of the opening and closing of the engine poppet valves is by means of a variable cam phase change device ("variable cam phaser"). The function of such a variable cam phaser device is to vary the angular position of the camshaft, relative to the angular position of the crankshaft. However, providing the typical internal combustion engine with variable cam phaser capability would add substantially to the overall cost of the engine.

Those skilled in the valve gear train art have, for many years, been developing various systems for variable valve actuation/variable valve timing ("VVA/VVT") for modifying the amount of valve lift and/or the timing of the valve lift in valve gear trains of the type driven by a camshaft. Those developments may be divided into several categories in order to better understand design approaches followed by the prior art, and also to better understand the design philosophy and benefits of the present invention.

In a first category are those VVA/VVT mechanisms which are able to achieve "lift" of the engine poppet valve in response to oscillation of a cam member, wherein, the movement of the cam member in a first direction occurs in response to rotation of the camshaft, but the "return" movement in the second, opposite direction, permitting the poppet valve to close, requires a biasing spring. An example of such a mechanism is illustrated in U.S. Pat. No. 6,019,076.

As is well known to those skilled in the art, there are a number of disadvantages to such a mechanism which requires a biasing spring. First, if the oscillating cam is moved in the second direction by means of a biasing spring, then each time the oscillating cam moves in the first direction, the biasing force of the spring must be overcome, thus substantially increasing the overall energy consumption by the mechanism. In addition, springs of the type required for such a mechanism tend to be large and expensive, thus substantially increasing the overall size, weight, and cost of the mechanism. Also, it is fairly common for springs to exhibit a variable spring force over the life of the spring, thus introducing an undesirable variability, over time, into the operation of the valve gear train. Finally, the presence of such springs is likely to be one of the primary failure modes of such a mechanism.

Accordingly, it is an object of the present invention to provide a variable valve actuation assembly which does not require a biasing spring to achieve any portion of the movement of the assembly, thereby overcoming the disadvantages of the prior art spring-type mechanisms.

It is another object of the present invention to provide a variable valve actuation assembly which is capable of being "unitized" on and about the camshaft, as that term will be explained further hereinafter, which is extremely difficult to do if the mechanism is required to include a biasing spring.

Those skilled in the art have attempted to overcome the disadvantages associated with the spring-type mechanisms by developing a second category of VVA/VVT mechanisms which are classified as "desmodromic". As used herein, the term "desmodromic" will be understood to mean and include a VVA/VVT type device in which the input rotation of the camshaft actuates the mechanism in both the valve opening and the valve closing directions (i.e., moving the oscillating cam in both the first direction and the second direction), thus avoiding the need to provide a return biasing spring.

Examples of such desmodromic VVA/VVT mechanisms are illustrated and described in U.S. Pat. Nos. 6,123,053 and 6,378,474. In the mechanisms of the cited patents, the mechanism is desmodromic because of the presence of a particular type of eccentric mechanism, whereby rotation of the camshaft is able to move the mechanism in both the valve opening direction and the valve closing direction, without the help of a return biasing spring. However, in the mechanisms of the cited patents, the particular eccentric mechanism selected introduces an extra output motion, generally perpendicular to the desired output motion. The mechanism must be able to effectively "filter out" this extra, unproductive output motion, thus adding to the number of parts, complexity and cost of the overall mechanism.

In the prior art VVA/VVT mechanisms which are desmodromic, such as those in the cited patents, and partly as a result of the "extra" output motion described above, the designs typically require too many "pin connections" between adjacent members which must be free to pivot relative to each other. An excessive number of pin connections in such a mechanism adds substantially to the overall tolerance stack-up of the mechanism, which may introduce inaccuracies (looseness or "slop") in the mechanism, or at the very least, may require that each such mechanism be individually adjusted after assembly. Also, such pin connections represent additional potential "wear" points, such that, the greater the number of pin connections in a mechanism, the greater will likely be the accumulated wear and inaccuracy over the life of the mechanism.

Accordingly, it is an object of the present invention to provide a variable valve actuation assembly of the type which is desmodromic, but which overcomes the disadvantages of the prior art devices discussed immediately above.

It is a more specific object of the present invention to provide a variable valve actuation assembly which achieves the above-stated objects, but which is relatively simple and inexpensive, and would typically not require individual adjustment at assembly.

BRIEF SUMMARY OF THE INVENTION

The above and other objects of the invention are accomplished by the provision of an improved variable valve actuation assembly for use in an internal combustion engine of the type having valve means for controlling the flow to and from a combustion chamber, and a camshaft rotating in timed relationship to the events in the combustion chamber. The camshaft includes a concentric portion disposed to be concentric relative to an axis of rotation of the camshaft, and an eccentric portion disposed to be eccentric relative to the axis of rotation of the camshaft, and the eccentric portion defines an axis. The valve actuation assembly includes means defining a cam follower surface operable to provide opening and closing movement of the valve means in response to cyclic downward and upward movement of the cam follower surface. The valve actuation assembly further includes a cam member rotatably disposed about the concentric portion of the camshaft and including a cam surface disposed to be in engagement with the cam follower surface.

The improved variable valve actuation assembly is characterized by the assembly further comprising an arm assembly disposed in surrounding relationship about the eccentric portion of the camshaft. The arm assembly defines a longitudinal axis intersecting the axis defined by the eccentric portion and is perpendicular thereto. The arm assembly defines a longitudinal slot receiving the eccentric portion whereby the arm assembly is free to move transversely relative to the eccentric portion. The arm assembly defines a first relatively fixed pivot location and a second pivot location, the first and second pivot locations being longitudinally oppositely disposed about the eccentric portion. The cam member defines a connection location pivotally connected to the second pivot location of the arm assembly whereby eccentric movement of the eccentric portion about the axis of rotation of the camshaft causes the arm assembly to pivot about the first pivot location, causing oscillating rotation of the cam member.

DETAILED DESCRIPTION OF THE PREFERRED EMBODIMENT

Figure 1:
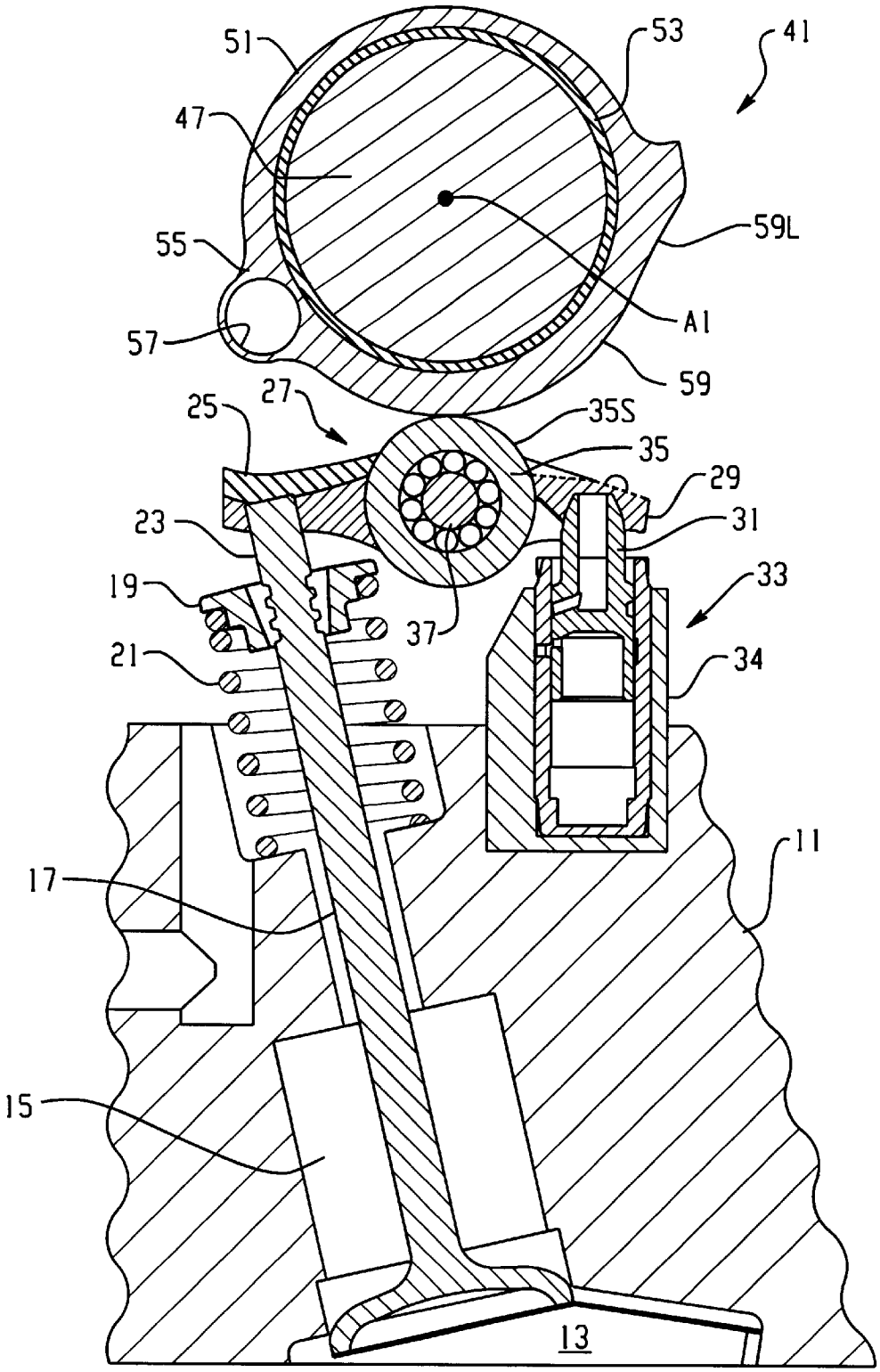
FIG. 1 is a fragmentary, transverse cross section illustrating an internal combustion engine cylinder head assembly including the variable valve actuation assembly of the present invention, and taken on line 1—1 of FIG. 2.

Referring now to the drawings, which are not intended to limit the invention, FIG. 1 illustrates a variable valve actuation assembly made in accordance with the present invention, for use in controlling an engine poppet valve of an internal combustion engine. It should be noted that FIG. 1 illustrates only the cylinder head and the valve gear train of the present invention, and then only fragmentarily, but does not include any portion of the engine cylinder block.

Figure 5:
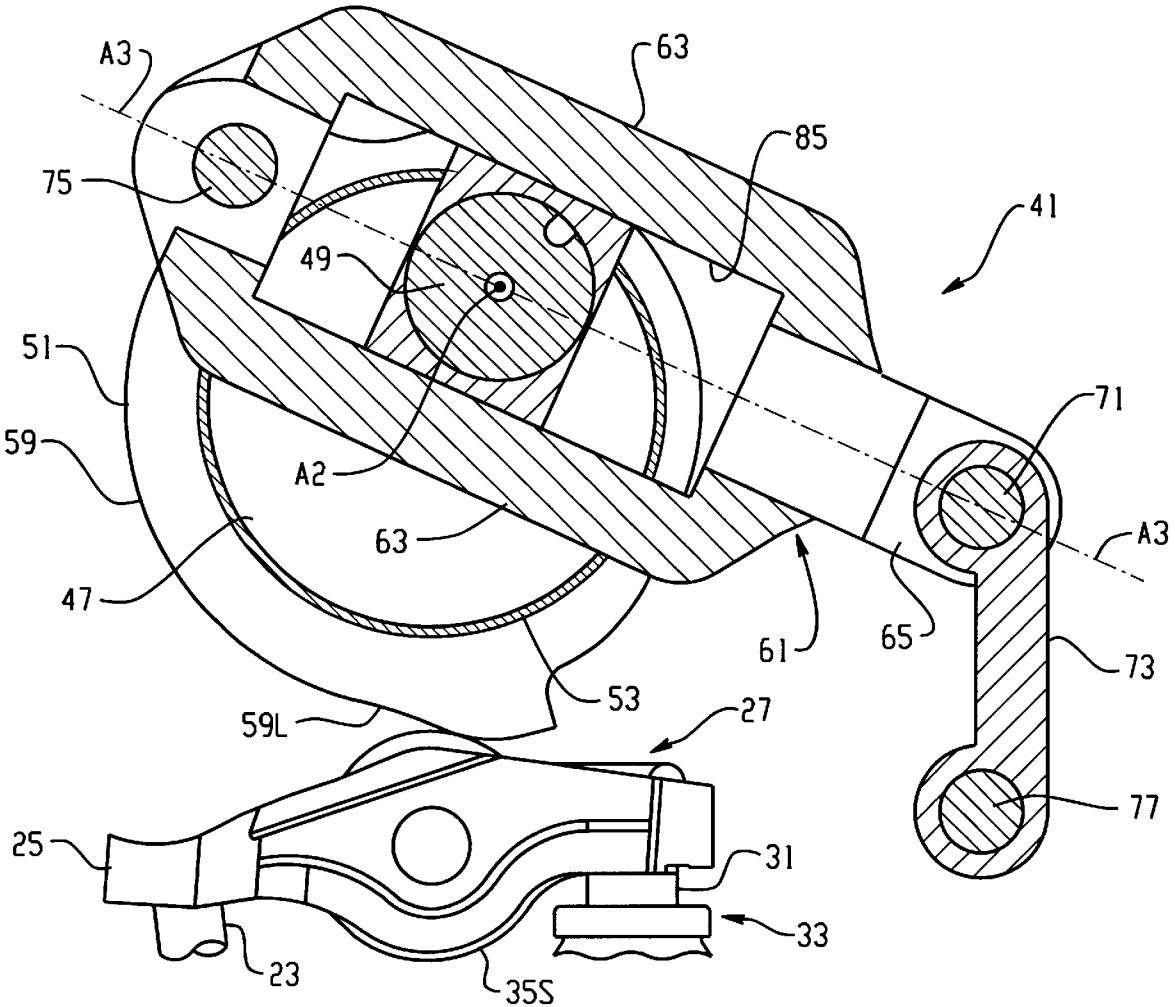
FIG. 5 is an enlarged, fragmentary, transverse cross-section, similar to FIG. 3, but on a slightly smaller scale, and with the camshaft rotated about 180 degrees from the position shown in FIG. 3, such that the engine poppet valve would be at approximately its maximum valve lift.

The variable valve actuation assembly as shown in FIG. 1 includes a cylinder head 11 defining an upper portion 13 of a combustion chamber, the rest of which would be defined by the cylinder block, and more specifically by the cylinder and piston. The cylinder head 11 defines an intake passage 15, only a portion of which is shown in FIG. 1. The flow of air-fuel mixture to the upper portion 13 of the combustion chamber is accomplished by means of an intake engine poppet valve 17. Each intake poppet valve 17 is supported for reciprocable movement relative to the cylinder head 11 between a closed position (shown in FIG. 1) and an open position. Thus, as is well known to those skilled in the art, the references herein to valve "lift" mean the downward movement of the poppet valve 17 from the closed position of FIG. 1 to an open position (i.e., wherein the valve is "lifted" from the valve seat), as is represented in the view of FIG. 5.

The upper end of each poppet valve 17 includes a spring retainer 19, against which is seated a valve return spring 21, which biases the poppet valve 17 toward the closed position of FIG. 1. Although the present invention is being illustrated and described in connection with the operation of the intake engine poppet valve 17, the invention is not so limited, and may also be used in connection with the operation of an exhaust engine poppet valve (not shown herein).

In engagement with an upper end (tip) 23 of the poppet valve 17 is a valve engaging end 25 of a rocker arm assembly 27. At the opposite, axial end of the rocker arm assembly 27 is a pivot end 29, which is seated on a plunger portion 31 of a hydraulic lash adjuster, generally designated 33. As is well known to those skilled in the art, the hydraulic lash adjuster 33 is typically seated in a bore defined by the cylinder head 11, but as shown in FIG. 1, the lash adjuster 33 is disposed in a mounting block 34 which, in turn, is disposed within a bore defined by the cylinder head 11. Disposed intermediate the ends 25 and 29, the rocker arm assembly 27 includes a roller member 35 defining on its outer periphery a cam follower surface 35S. Preferably, the roller member 35 is rotatably mounted relative to the rocker arm assembly 27 by means of an axle shaft 37 (see also FIG. 3), as is conventional in the rocker arm art.

It should be understood by those skilled in the art that the variable valve actuation assembly of the present invention is not limited to any particular configuration or arrangement of the cylinder head 11, nor is it limited to any particular style or configuration of rocker arm assembly 27, nor is the invention even limited to a valve gear train which includes a rocker arm assembly. All that is essential to the present invention is that the valve gear train includes some sort of mechanism which is operable to provide opening and closing movement of the engine poppet valve 17 in response to cyclic downward and upward movement of a cam follower surface.

Figure 2:
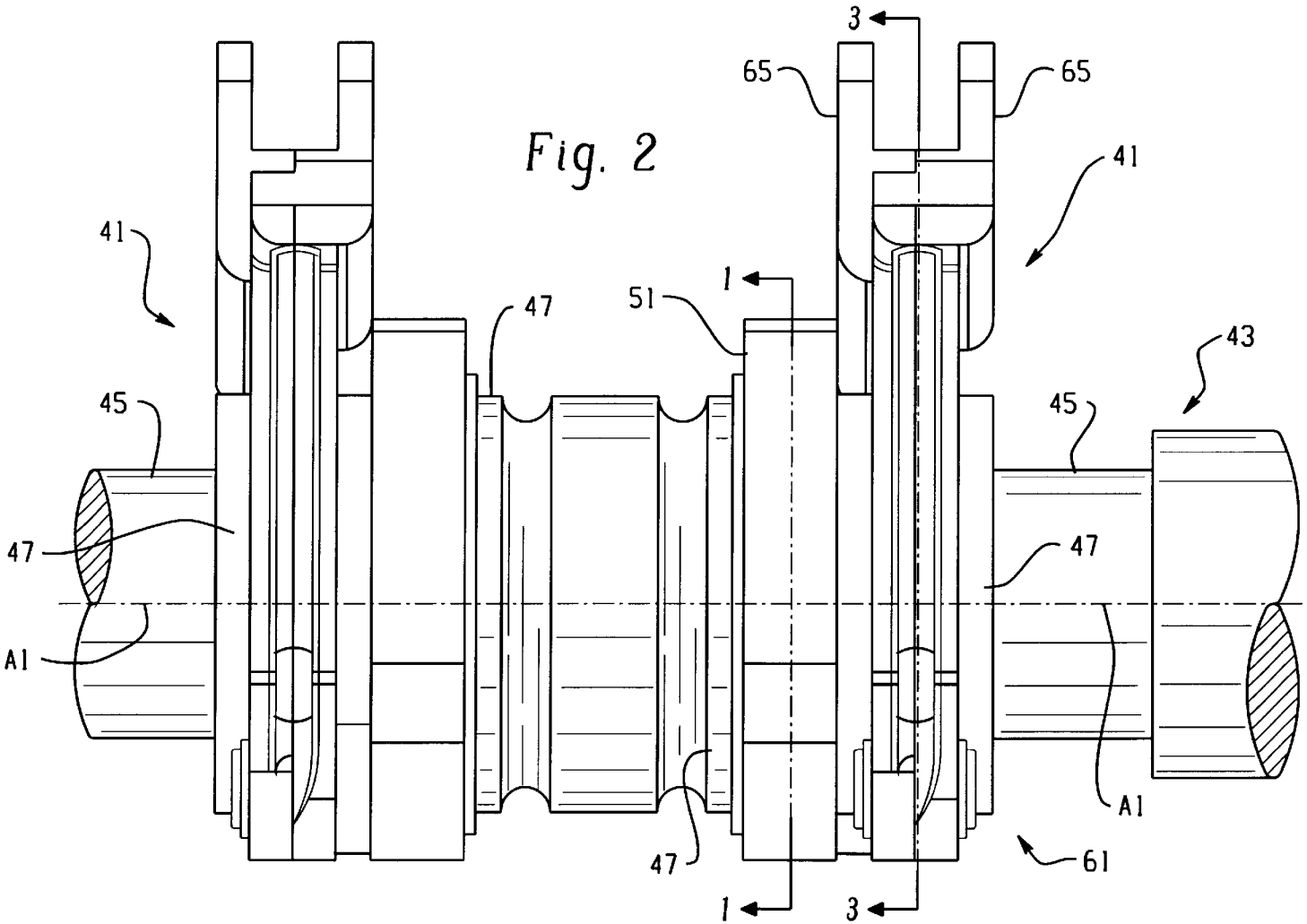
FIG. 2 is a top, plan view of a camshaft and a pair of variable valve actuation assemblies, made in accordance with the present invention, and shown on about the same scale as FIG. 1.

Referring now to FIG. 2, in conjunction with FIG. 1, there is a pair of variable valve actuation assemblies, each generally designated 41, disposed on a camshaft, generally designated 43. As is shown primarily in FIG. 2, the camshaft 43 defines an axis of rotation A1, and includes a pair of mounting portions 45, concentric about the axis of rotation A1, and adapted to be received within sets of cam journals (not shown herein) defined by the cylinder head 11, whereby the camshaft 43 is supported for rotation relative to the cylinder head 11. Thus, and as will be described in greater detail subsequently, it is an important aspect of the present invention that the variable valve actuation assembly 41 may be "unitized" on the camshaft 43, so that the assembly 41 and the camshaft 43, together, can simply be put in place on the cam journal lower half, seated in the cylinder head 11, but not shown herein.

Figure 3:
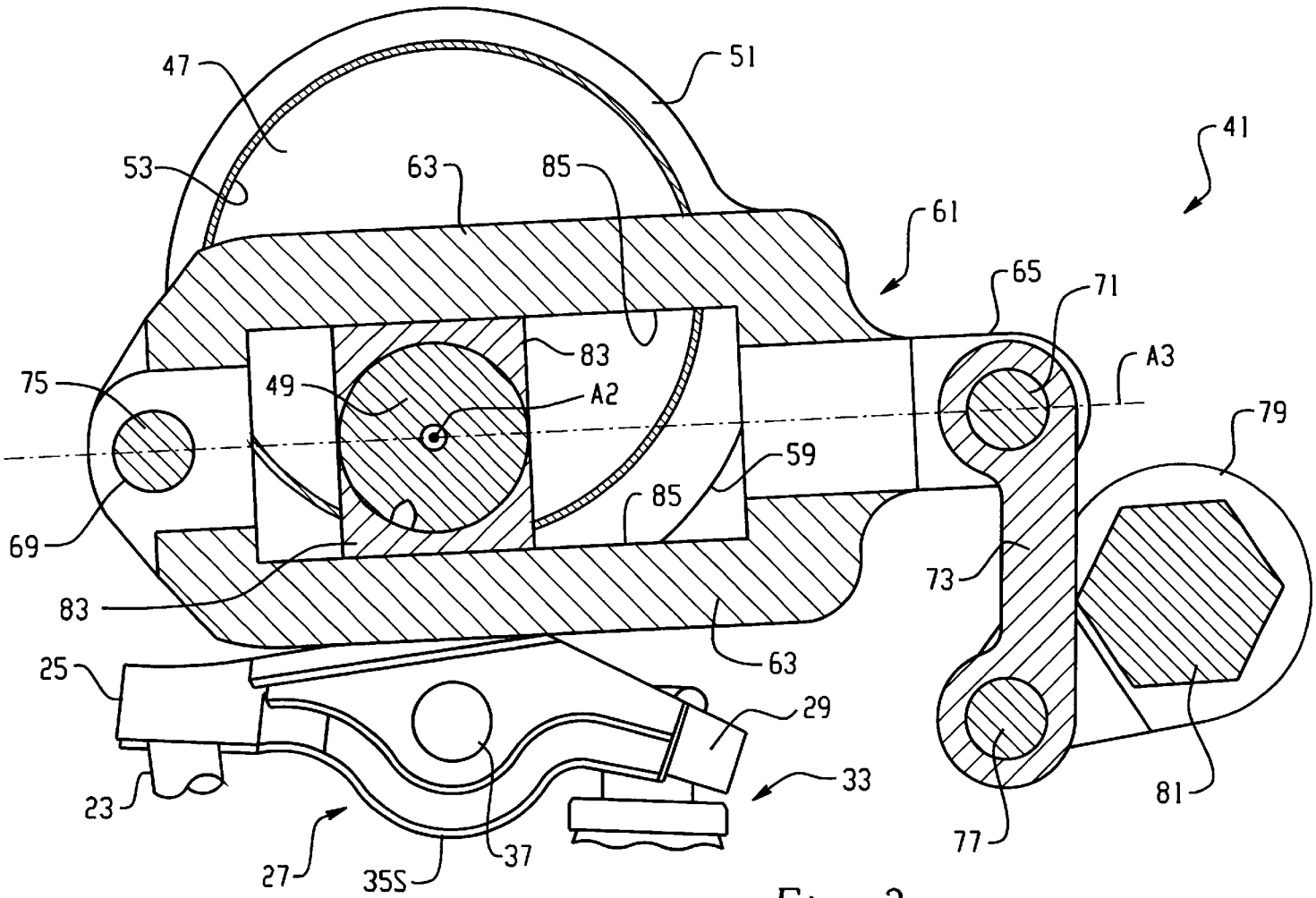
FIG. 3 is an enlarged, fragmentary, transverse cross section, similar to FIG. 1, and taken on line 3—3 of FIG. 2, illustrating the variable valve actuation assembly of the present invention on a plane different than that of FIG. 1.

The camshaft 43 also includes a pair of relatively large concentric portions 47, one of which is shown in FIG. 1, and which are partially hidden in the top plan view of FIG. 2, but which are visible extending beyond either axial end of the assembly 41. It should be noted that the concentric portion 47 shown in FIG. 3 is an external, plan view of the one shown in cross section in FIG. 1. The other concentric portion 47 is similarly partially hidden from view in FIG. 2 by the other variable valve actuation assembly 41, disposed toward the left end of the camshaft 43 in FIG. 2.

The camshaft 43 also includes a pair of relatively smaller eccentric portions 49, shown only in FIGS. 3 and 5. Each of the eccentric portions 49 defines an axis of rotation A2 which is disposed parallel to, but eccentric from, the axis of rotation A1 of the camshaft 43. Thus, when the camshaft 43 rotates about the axis of rotation A1, the axis of rotation A2 of the eccentric portion 49 orbits about the axis of rotation A1, and in the same direction as the camshaft 43 is rotating (assumed to be clockwise for purposes of subsequent description).

Referring again primarily to FIG. 1, the variable valve actuation assembly 41 includes a secondary cam member 51 which is rotatably mounted about the concentric portion 47 by means of an annular journal bearing 53. As may best be seen in FIG. 1, the secondary cam member 51 is generally annular, but has a non-uniform radial wall thickness. Disposed toward the left end (in FIG. 1) of the cam member 51 is a boss portion 55 defining a cylindrical pin bore 57, the function of which will be described subsequently. As is shown only in FIG. 1, the wall thickness of the cam member 51, extending from the boss portion 55 around the underside of the concentric portion 47 and extending to the right, is substantially thicker than the diametrically opposed, top portion of the cam member 51. It is the thicker, bottom portion of the cam member 51 which is in engagement with the cam follower surface 35S of the roller member 35, and the outer peripheral surface of this bottom portion of the cam member 51 comprises a cam surface 59.

It should be noted in FIG. 1 that the cam surface 59, from about the six o'clock position (the point at which it engages the cam follower surface 35S in FIG. 1), to about the three o'clock position, has nearly a constant radius relative to the axis of rotation A1, and therefore, would provide no downward movement of the roller member 35, and therefore, no valve "lift". It is only when the cam member 51 rotates clockwise sufficiently that a lift portion 59L of the cam surface 59 begins to engage the cam follower surface 35S, that downward movement of the roller member 35 will occur, as will be readily understood by those skilled in the art.

Figure 4:
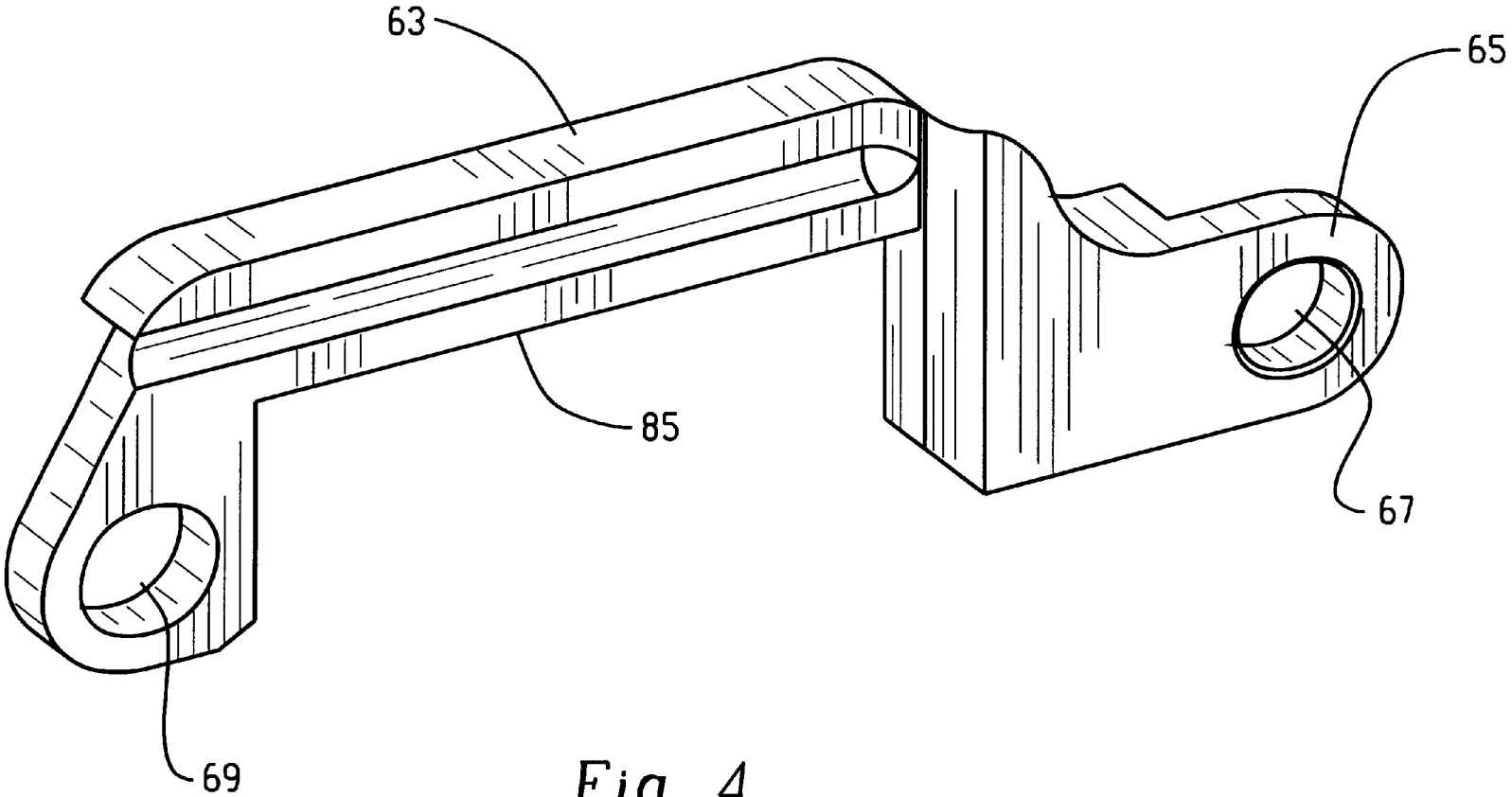
FIG. 4 is a perspective view of one of the arm members comprising part of the arm assembly, shown in FIG. 3, and on a somewhat smaller scale than FIG. 3.

Referring now primarily to FIG. 3, one important aspect of the invention will be described. Disposed about the eccentric portion 49 of the camshaft 43 is an arm assembly, generally designated 61. The arm assembly 61, in the subject embodiment, and by way of example only, comprises a pair of identical arm members 63, one of which is shown in perspective view in FIG. 4. Each arm member 63 includes an axially-extending tab portion 65 (see also FIG. 2), which defines a pin bore 67. Disposed at the axial end, opposite the tab portion 65, each arm member 63 also defines a pin bore 69. When a pair of the arm members 63 are assembled, to form the arm assembly 61 shown in FIG. 3, the two pin bores 67 are aligned (although axially spaced apart as may be seen in FIG. 2), and the two pin bores 69 are aligned (and axially, immediately adjacent each other).

Referring still primarily to FIG. 3, the arm assembly 61 includes a generally cylindrical pin member 71 which extends through one of the pin bores 67, then through an opening of a control link 73 (which is not shown in FIG. 2, and the function of which will be described subsequently), and then through the other pin bore 67. Disposed at the axially opposite end of the arm assembly 61 is another, generally cylindrical pin member 75 which extends through both of the pin bores 69, and is also received within the pin bore 57 defined by the cam member 51.

The lower end of the control link 73 is pivotally connected, by means of a pin member 77, to one end of an actuator control arm 79. The control arm 79 defines an hexagonal opening, and disposed therein is an hexagonal control shaft 81, the function of which will be described subsequently. At any given instant in time during the operation of the present invention, the control shaft 81 is stationary and therefore the control link 73 is not moveable, vertically, although the control link 73 is able to pivot somewhat about the pin member 77. Thus, instantaneously, the pin member 71 comprises a "fixed" pivot location about which the arm assembly 61 can rotate, and therefore, the pin member 71 is also referred to hereinafter, and in the appended claims, as a "first relatively fixed pivot location", also bearing the reference numeral "71".

The connection of the pin member 75 to the arm assembly 61, and to the cam member 51, permits relative pivotal movement between the cam member 51 and the arm assembly 61, and therefore, the pin member 75 is referred to hereinafter as a "second pivot location", and when used hereinafter, the phrase "second pivot location" also bears the reference numeral "75". Although the subject embodiment has been described in connection with the use of pin members 71, 75, and 77, it should be understood by those skilled in the art that all that is essential to the present invention is to provide some structure by which the required relative pivotal movement can occur, i.e., pivotal movement of the arm assembly 61 relative to the "ground", and pivotal movement between the assembly 61 and the cam member 51, Secondarily, the structure should provide a "ground" for the arm assembly 61, in a generally vertical direction, while permitting some freedom of movement in a plane perpendicular thereto, for reasons which will become apparent subsequently.

Referring still primarily to FIG. 3, the arm assembly 61 defines a longitudinal axis A3 which, in the subject embodiment, and by way of example only, passes through the axes of the pivot locations 71 and 75. The longitudinal axis A3 also intersects the axis A2 of the eccentric portion 49, and is preferably disposed perpendicular thereto for reasons which will become apparent subsequently.

Disposed about the eccentric portion 49 is a pair of generally U-shaped crank journals 83 which together provide a journal bearing between the eccentric portion 49 and the arm assembly 61. The arm assembly 61 comprises a pair of parallel, longitudinal surfaces 85 which cooperate to define a slot, with the slot hereinafter also bearing the reference numeral "85". In other words, each of the arm members 63 defines one of the longitudinal surfaces 85, as may be seen in FIG. 4, and the assembly of two of the arm members 63 defines the slot 85.

Referring still primarily to FIG. 3, as the camshaft 43 rotates in the clockwise direction, the axis A2 of the eccentric portion 49 orbits in a clockwise direction around the axis of rotation A1 (hidden from view in FIG. 3, but visible in FIG. 1). With the position of the variable valve actuation assembly 41, as shown in FIG. 3, corresponding to the closed or zero lift position of the engine intake poppet valve 17, the above-described orbiting movement of the eccentric portion 49 results in the eccentric portion 49 and the pair of crank journals 83 sliding to the left within the slot 85, toward the pin member 75 while, at the same time, the arm assembly 61 begins to pivot in a clockwise direction about the first relatively fixed pivot location 71.

Referring now also to FIG. 1, in conjunction with FIG. 3, it may be seen that, as the arm assembly 61 pivots clockwise, the pin member 75 will travel in a clockwise rotation about the concentric portion 47, thus rotating the cam member 51 a fixed number of degrees in the clockwise direction, from the position shown in FIG. 1. As the camshaft 43 continues to rotate, the eccentric portion 49 will eventually reach the position shown in FIG. 5 such that the lift portion 59L of the cam surface 59 comes into engagement with the cam follower surface 35S, thus pivoting the rocker arm assembly 27 in a counterclockwise direction about the plunger portion 31, and moving the engine poppet valve 17 downward, toward its maximum open maximum lift condition, as may also be seen by reference to the graph of FIG. 6.

As the eccentric portion 49 continues to rotate from the position shown in FIG. 5 back toward the position shown in FIG. 3, the arm assembly 61 now reverses direction and, for the next portion of rotation of the camshaft 43, the arm assembly 61 will pivot in a counterclockwise direction about the first relatively fixed pivot location 71. During the above-described second portion or closing portion of the cycle, the pin member 75 is also traveling in a counterclockwise direction about the relatively fixed pivot location 71, and about the concentric portion 47, thus rotating the cam member 51 from the position shown in FIG. 5, with the lift portion 59L initially engaging the cam follower surface 35S, until the cam follower surface 35S is again engaged by the cam surface 59 at a location closer to the boss portion 55, i.e., the position shown in FIG. 1. During this closing portion of the cycle, the engine poppet valve 17 returns to its closed position shown in FIG. 1, under the influence of the valve return spring 21, as is well known to those skilled in the art.

In accordance with an important aspect of the present invention, the variable valve actuation assembly 41, and especially the arm assembly 61 and eccentric portion 49 as shown in FIG. 3, are able to impart a purely oscillating rotational motion to the cam member 51, as the arm assembly 61 undergoes its own oscillating pivotal motion about the pivot location 71. The term "oscillating" is used herein in reference to the motions of the cam member 51 and the arm assembly 61 because each moves no more than about 180 degrees in one direction before stopping, and changing directions. Also, one benefit of the present invention is that the secondary cam member 51 always pivots (or oscillates) through the same angular displacement, regardless of the amount of lift then being achieved by the assembly 41. As a result, the overall mechanism can be much simpler than would be the case if the secondary cam member 51 engaged in variable amounts of travel, depending on the instantaneous lift being achieved. This feature will be referred to further hereinafter.

It should also be noted that during the operating cycle as described above, during which the eccentric portion 49 rotates from the position shown in FIG. 3 to that shown in FIG. 5, and back to the position shown in FIG. 3 again, the arm assembly 61 will not only undergo an oscillating pivotal movement as described above, but will also move somewhat parallel to its longitudinal axis A3, simply as a result of the geometry of the various parts involved. Such longitudinal movement of the arm assembly 61 is permitted by the pivotal connection of the control link 73 to the actuator control arm 79, such that during one complete cycle of the mechanism, the control link 73 will also undergo some pivotal movement about its pin member 77. Therefore, the pin member 71 has been referred to as a "relatively" fixed pivot location because, during normal operation (while no rotation of the control shaft 81 is occurring), the pin member 71 can move a small amount in a direction generally parallel to the longitudinal axis A3, but cannot move in a direction perpendicular to the axis A3. Thus, the use of the term "relatively" fixed, in regard to the pivot location 71.

Alternatively, and within the scope of the present invention, the control link 73 could be eliminated, although it has been illustrated and described in connection with the preferred embodiment, in part, to facilitate an explanation of the operation of, and the essential features of, the invention. If the control link 73 were to be eliminated, the pin bores 67 would be replaced by elongated slots (i.e., elongated parallel to the longitudinal axis A3), and the pin member 71 would pass through the pin bore (no reference numeral given previously) in the actuator control arm 79. As would be apparent to those skilled in the art, utilizing this alternative, the control arm 79 and the control shaft 81 would have to be disposed up next to the tab portions 65 of the arm assembly 61. This alternative would make the assembly 41 of the present invention even more compact, simple and inexpensive.

Figure 6:
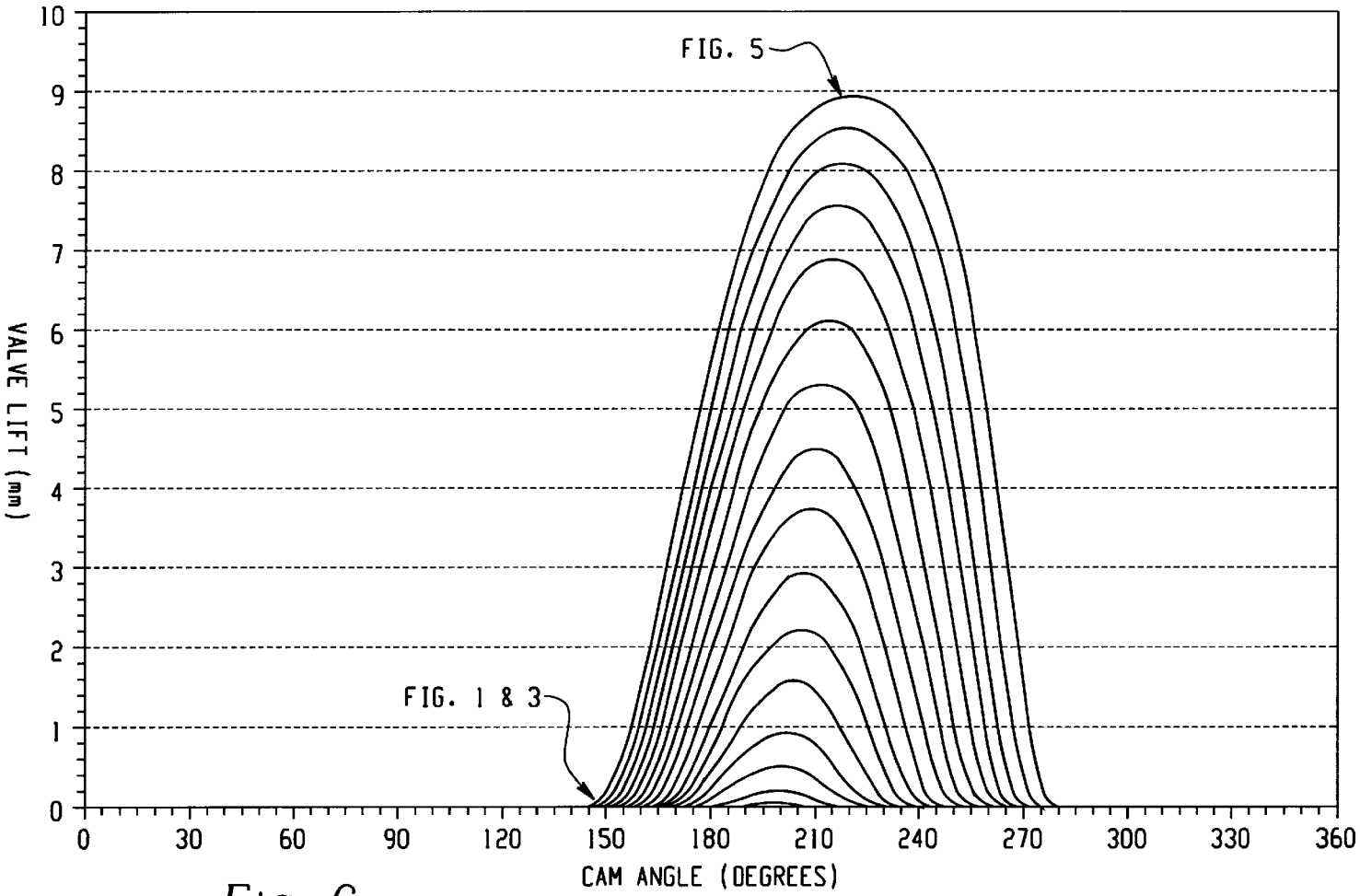
FIG. 6 is a family of graphs of Valve Lift (in millimeters) versus engine camshaft rotation ("Cam Angle", in degrees), illustrating one aspect of the present invention.

What has been described up to this point is simply the operation of the variable valve actuation assembly 41 in a maximum lift mode (approximately 9 mm as shown in the graph of FIG. 6), whereby the engine poppet valve 17 undergoes maximum opening and closing movement (lift). However, in accordance with another important aspect of the invention, if the engine operating conditions are such that full opening of the poppet valve 17 (maximum valve lift) is no longer desirable, the control shaft 81 can be rotated a small amount in a clockwise direction by an appropriate actuator (not shown herein). Such movement of the control shaft 81 will result in corresponding rotation of the actuator control arm 79, thus moving the control link 73 in a general "upward" direction in FIG. 3, and moving the pin member 71 in a direction generally perpendicular to the axis A3 (more specifically, upward in FIG. 3). When such control movement has occurred, the pin member 71 moves to a new position, and thereafter, again functions as a relatively fixed pivot location, as long as the control shaft 81 remains in that particular rotational orientation.

As may best be seen in FIG. 3, moving the pin member 71 upward in FIG. 3 will cause the arm assembly 61 to pivot counter-clockwise about the axis A2, and cause the pin member 75 to travel a short distance in a counterclockwise direction about the concentric portion 47. Such travel of the pin member 75 has the effect of rotating (or "indexing") the secondary cam member 51 in the counterclockwise direction. In other words, the initial (i.e., at zero valve lift) point of engagement of the cam follower surface 35S and the cam surface 59 will now be disposed counter-clockwise from the initial point of engagement shown in FIGS. 1 and 3. Such indexing of the secondary cam member 51 means that the cam member 51 will have to rotate further in the clockwise direction before the cam follower surface 35S begins to engage the lift portion 59L.

In accordance with another important aspect of the invention, the geometry of the variable valve actuation assembly 41 is such that, regardless of the position of the control shaft 81, the amount of pivotal movement of the arm assembly 61, and therefore, the amount of rotational movement of the cam member 51, is always the same, for one rotation of the camshaft 43. Therefore, in order to vary the amount of lift of the poppet valve 17, the control shaft 81 may be rotated as described above, which simply serves to change the angle of the axis A3 when the assembly 41 is in its initial ("starting") position, or zero lift condition, wherein the eccentric portion 49 is in the position shown in FIG. 3.

Therefore, rotating the control shaft 81 clockwise, and changing the angle of the arm assembly 61 and the axis A3, in its starting position, changes the starting rotational position of the cam member 51, as described previously. Thereafter, during the normal operating cycle, the cam member 51 will engage in the oscillating rotation described previously, and over the same number of degrees of rotation, but because the cam member 51 has started in a position somewhat counter-clockwise from that shown in FIG. 1, the point of engagement of the cam follower surface 35S and the cam surface 59 will not progress as far up the lift portion 59L as was the case when the assembly 41 was in the maximum lift condition shown in FIG. 3.

As may best be seen by reference to the graph of FIG. 6, as the control shaft 81 rotates clockwise from the position shown in FIG. 3, two changes occur. First, the amount of lift decreases, for the reasons explained previously, and as may be seen in FIG. 6. In the subject embodiment, and by way of example only, each additional 2.6 degrees of rotational movement of the control shaft 81 results in a new "lift curve" immediately under the one above, such that, after a total of about 40 degrees of rotation of the control shaft 81, the assembly will be in a position in which rotation of the camshaft 43 results in no substantial opening or lift of the engine poppet valve 17. Secondly, as the control shaft 81 is rotated clockwise to reduce the amount of lift, the "timing" of the valve opening is delayed or retarded. For example, in the maximum lift condition of FIGS. 1, 3 and 5, the poppet valve 17 begins to open at about 148 degrees of camshaft rotation, but when the assembly 41 is in a condition corresponding to a valve lift of only about 3 mm., the poppet valve 17 does not begin to open until about 165 degrees of camshaft rotation.

It is one important advantage of the present invention that the relationship of decreasing valve lift to delayed valve timing, as illustrated in FIG. 6, appears to be inherent in, or at least is capable of being inherent in, the particular variable valve actuation assembly 41 shown and described herein. It is believed that of the various possible "lift-to-timing" relationships possible (or inherent in the particular mechanism design), the relationship illustrated in FIG. 6 most nearly matches what is now considered to be the "ideal" relationship for a mechanism not having the ability to vary lift and timing independently. As is well known to those skilled in the art, providing a variable valve actuation assembly with independent lift and timing control adds substantially to the overall complexity and cost of the assembly.

In accordance with another important aspect of the present invention, and as was mentioned previously, the variable valve actuation assembly 41 and the camshaft 43, together, are "unitized". As used herein, the term "unitized" will be understood to mean that all essential parts of the variable valve actuation assembly 41 are mounted on and about the camshaft 43, such that the assembly 41 (or a pair of the assemblies 41 as shown in FIG. 2), and the camshaft 43, together, can be put in place on the camshaft journal surface seated in the cylinder head 11. It will be understood that "essential parts", as used herein, refers to everything excluding the actuator control arm 79 and the control shaft 81, which are separately mounted, relative to the cylinder head 11, and can then be connected to the assembly 41 by means of the pin member 77.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A variable valve actuation assembly for use in an internal combustion engine of the type having valve means for controlling the flow to and from a combustion chamber, and a camshaft rotating in timed relationship to the events in the combustion chamber, said camshaft including a concentric portion, disposed to be concentric relative to an axis of rotation of said camshaft, and an eccentric portion disposed to be eccentric relative to said axis of rotation of said camshaft, said eccentric portion defining an axis; said valve actuation assembly including means defining a cam follower surface operable to provide opening and closing movement of said valve means in response to cyclic downward and upward movement of said cam follower surface; said valve actuation assembly further including a cam member rotatably disposed about said concentric portion of said camshaft and including a cam surface disposed to be in engagement with said cam follower surface, characterized by:

(a) said valve actuation assembly further comprising an arm assembly disposed in surrounding relationship about said eccentric portion of said camshaft;

(b) said arm assembly defining a longitudinal axis intersecting said axis defined by said eccentric portion and perpendicular thereto;

(c) said arm assembly defining a longitudinal slot receiving said eccentric portion whereby said arm assembly is free to move transversely relative to said eccentric portion;

(d) said arm assembly defining a first, relatively fixed pivot location and a second pivot location, said first and second pivot locations being longitudinally, oppositely disposed about said eccentric portion; and (e) said cam member defining a connection location pivotally connected to said second pivot location of said arm assembly whereby eccentric movement of said eccentric portion about said axis of rotation of said camshaft causes said arm assembly to pivot about said first, relatively fixed pivot location, causing oscillating rotation of said cam member.

2. A variable valve actuation assembly as claimed in claim 1, characterized by said means defining a cam follower surface comprising a rocker arm assembly including a roller follower member defining said cam follower surface, said rocker arm assembly having a pivot end and a valve-engaging end, said ends being longitudinally, oppositely disposed about said roller follower member.

3. A variable valve actuation assembly as claimed in claim 1, characterized by said cam member comprising a generally annular member having non-uniform radial wall thickness and including an outer surface defining said cam surface.

4. A variable valve actuation assembly as claimed in claim 1, characterized by a control link being pivotally connected to said arm assembly at said first, relatively fixed pivot location and including adjustment means operable to adjust the position of said control link.

5. A variable valve actuation assembly as claimed in claim 1, characterized by said arm assembly comprising a pair of substantially identical arm members, said arm members being joined together to form said arm assembly by means of only said first, relatively fixed pivot location and said second pivot location.

6. A variable valve actuation assembly as claimed in claim 5, characterized by each of said arm members defines first and second pin bores, and said first, relatively fixed pivot location comprises a first pin member, and said second pivot location comprises a second pin member.

7. A variable valve actuation assembly as claimed in claim 1, characterized by means operable to vary the orientation of said longitudinal axis of said arm assembly, whereby said opening and closing movement of said valve means may be varied from a maximum valve opening condition to a minimum valve opening condition, corresponding to said variations in said orientation of said longitudinal axis.

8. A variable valve actuation assembly as claimed in claim 7, characterized by said opening and closing movement of said valve means defines an opening timing, and as said opening and closing movement is varied from said maximum valve opening condition to said minimum valve opening condition, said opening timing is correspondingly delayed.

* * * * *